US007162909B2

(12) United States Patent
Kelly et al.

(10) Patent No.: US 7,162,909 B2
(45) Date of Patent: Jan. 16, 2007

(54) CRIMP TOOL FOR CRIMPING PIN AND SOCKET CONTACTS

(75) Inventors: William D. Kelly, Orlando, FL (US); Amos A. Moo-Young, Orlando, FL (US)

(73) Assignee: Daniels Manufacturing Corporation, Orlando, FL (US)

( * ) Notice: Subject to any disclaimer, the term of this patent is extended or adjusted under 35 U.S.C. 154(b) by 339 days.

(21) Appl. No.: 10/644,622

(22) Filed: Aug. 19, 2003

(65) Prior Publication Data

US 2004/0072378 A1 Apr. 15, 2004

Related U.S. Application Data

(60) Provisional application No. 60/406,520, filed on Aug. 28, 2002, provisional application No. 60/448,043, filed on Feb. 20, 2003.

(51) Int. Cl.
*H01R 43/042* (2006.01)

(52) U.S. Cl. ..... 72/409.14; 72/409.01; 72/402; 29/751

(58) Field of Classification Search ..... 72/409.14, 72/409.01, 402, 453.15, 453.16; 29/751, 29/753, 863, 867, 882
See application file for complete search history.

(56) References Cited

U.S. PATENT DOCUMENTS 2,409,549 A 10/1946 Djidics
2,714,827 A * 8/1955 Kusiv et al. ..... 72/402
3,049,951 A 8/1962 Rensink
3,094,702 A * 6/1963 Haucke et al. ..... 72/402
3,109,333 A * 11/1963 Anderson ..... 72/402
3,177,695 A 4/1965 Van Cort
3,534,583 A 10/1970 Demler, Sr.
3,713,322 A 1/1973 Fischer
3,833,993 A 9/1974 Kremkau
4,261,194 A 4/1981 Stephens
4,774,762 A 10/1988 Gobeil
5,415,015 A 5/1995 Klemmer et al.
5,440,799 A * 8/1995 Marshall et al. ..... 29/566.2
5,471,863 A * 12/1995 Hornung ..... 72/402
5,625,942 A 5/1997 Casey
5,692,294 A 12/1997 Casey
5,715,723 A * 2/1998 Owens ..... 72/402
5,870,925 A 2/1999 Morris et al.
6,360,577 B1 3/2002 Austin
6,782,608 B1 * 8/2004 Ohsumi et al. ..... 29/753

* cited by examiner

*Primary Examiner*—Daniel C. Crane
(74) *Attorney, Agent, or Firm*—James H. Beusse; Beusse Wolter Sanks Mora & Maire, P.A.

(57) ABSTRACT

A compound indenter for a wire connector pin, the pin having an axial length and an opening at an end thereof for receiving a wire having an exposed portion and an insulation covered portion, the opening being sized to receive both the exposed portion and a length of the insulation covered portion comprises a first indenter having a plurality of indenting elements for engaging the pin in an axial location overlaying the exposed portion of the wire inserted in the pin and a second indenter having a plurality of indenting elements for engaging the pin in an axial location overlaying the insulation covered portion of the wire inserted in the pin. The apparatus advances the indenting elements of each of the first and second indenters generally concurrently for compressing respective sections of the pin into engagement with the exposed wire portion and the insulation covered portions of the wire.

12 Claims, 4 Drawing Sheets

CRIMP TOOL FOR CRIMPING PIN AND SOCKET CONTACTS

SPECIFIC DATA RELATED TO THE INVENTION

This application claims the benefit of U.S. provisional application No. 60/406,520, filed Aug. 28, 2002 and U.S. provisional application No. 60/448,043 filed Feb. 20, 2003.

BACKGROUND OF THE INVENTION

The present invention relates to a crimping tool for pin and socket contacts and more particularly, to a tool for crimping a pin at two separate distinct locations in which the pin has a different diameter at each location.

Connectors used for aircraft applications generally comply with military specifications (mil spec) standards which require waterproof connectors that utilize a plurality of male and female pins in opposite ends of a mating connector pair to complete electrical connections between wire leads or conductors connected to the connector pair. Typically, the pins are small diameter elements that are replaceable in each of the mating connector pairs. A typical male pin has an end portion that is generally solid and a rear portion which is hollow and designed to receive a bare or stripped wire of a conductor connected to the pin. Such pins generally require only a single crimp in order to fasten the pin to the conductor.

In a new application in which weight is a factor, the conventional copper wire conductors have been replaced by aluminum wire conductors. One problem that exists with aluminum wire conductors is that exposure of the conductor to moisture may result in corrosion of the aluminum wire. Consequently, it has been determined that the use of aluminum conductors requires that the insulating material over the conductor be inserted into the contact pin and crimped in place in order to provide a secure seal and preclude introduction of moisture onto the aluminum conductor where the insulation is stripped to allow electrical contact between the conductor and the pin. This requirement has resulted in a redesign of such contact pins so that the pins designed for this application have a dual diameter conductor receiving end so that the aluminum conductor can be stripped over a portion of its length for insertion into the pin while allowing a portion of the insulation on the conductor to also be inserted into the pin and the pin crimped on the insulation to thereby provide a seal to preclude moisture entry around the conductor. As a result of this redesign in pin structure, it has become necessary to provide a crimping tool which is capable of not only crimping the pin about the wire conductor portion but also crimping an enlarged portion of the pin about the insulation on the aluminum conductor. Furthermore, it is important to provide a crimping mechanism which completely crimps the pin about the conductor insulation in such a manner that moisture is precluded from entering around the pin to conductor coupling.

SUMMARY OF THE INVENTION

The present invention is directed to a new form of indenter for crimping an open end of a connector pin about an insulation covered wire in order to minimize intrusion of moisture into the pin to prevent oxidation of the wire attached to the pin. In one form, the invention comprises a compound indenter having a first indenter section for crimping an outer open end of the connection pin about the insulation and a second indenter section for crimping or indenting the pin so as to connect the pin to a metallic wire. In an illustrative example, the first indenter section utilizes a pair of opposed indenter elements having facing flat anvil surfaces and a second pair of opposed indenter elements having facing arcuate anvil surfaces. The first pair of flat surfaces are driven into contact with the open end of the pin to cause the open end to first deform into a generally oval configuration. Subsequently, the second pair of indenter elements having arcuate surfaces are driven into contact with the open end of the pin in a direction normal to the plane of the first pair of flat surfaces. The arcuate anvil surfaces compress the open end of the pin into a generally circular configuration while the flat surfaces prevent the open end of the pin from expanding outwardly during the compression cycle. The dual action of the two sets of indenter elements thus deform the open end of the pin into a generally circular configuration which fits tightly about the insulation covered wire inserted into the pin.

A second indenter section includes a plurality of indenter elements that are driven into contact with the pin concurrently with the elements of the first section so that the pin is indented at multiple locations to cause the pin to be crimped onto the non-insulation covered portion of the wire inserted into the pin.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
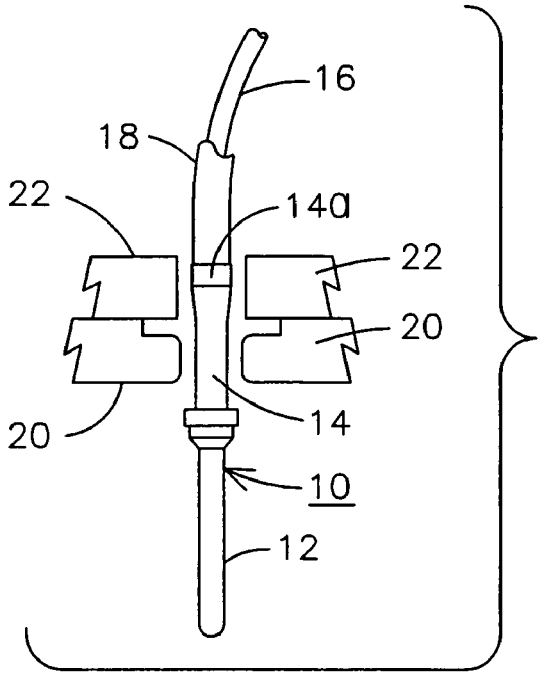
FIG. 1 is a schematic representation showing the location of a pair of indenters for crimping the pin at two spaced locations.

FIG. 1 illustrates a design of one form of connector pin 10 (sometimes referred to as a contact) having a contact tip 12 and a hollow portion 14 for receiving a nickel-plated aluminum conductor 16 from which insulation has been stripped and for receiving a length of conductor from which the insulation material 18 surrounding the conductor 16 has not been stripped. As can be seen, the open end 14*a* of the pin portion 14 has a larger diameter opening to allow the insulation material 18 to be inserted at least partially within the portion 14. FIG. 1 also shows the position of a first indenter 20 which is designed to crimp the pin 10 in a conventional manner so as to capture and hold the conductor 16 within the hollow portion 14. Positioned adjacent the portion 14*a* of the pin 10 is a second indenter 22 which is designed to crimp the portion 14*a* about the insulation 18 on the conductor 16. The indenter 22 is uniquely designed to assure that all sides of the portion 14*a* tightly encompass the insulation 18 to minimize moisture intrusion into the connector pin and potential corrosion of the exposed conductor 16.

Figure 2A:
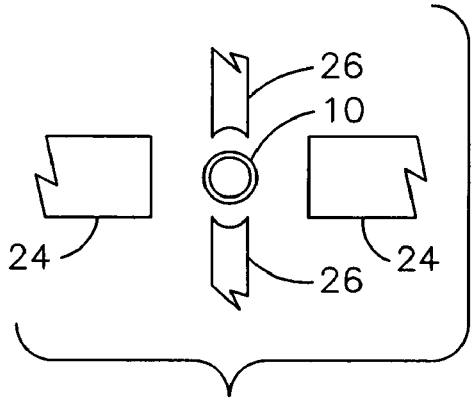
FIGS. 2*a*–2*c* illustrate a sequence of crimping actions for crimping an end of the connector pin of FIG. 1 about insulation on a wire.
Figure 2B:
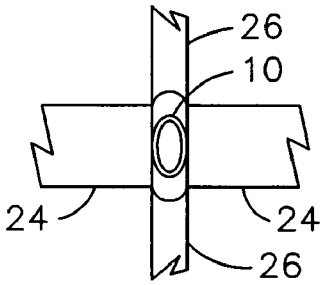
Figure 2C:
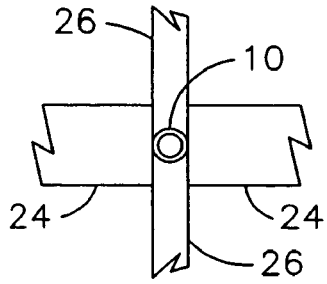

Turning now to FIGS. 2A–2C, there is shown an exemplary embodiment of one form of indenter 22 that may be used to provide the crimping of the section 14*a*. As shown in FIG. 2A, the indenter 22 comprises two flat tip indenter elements 24, sometimes referred to an anvils. These two indenter elements 24 are designed with flat anvil surfaces to first engage the connector pin portion 14*a* and to cause that pin portion to deform into the oval shape shown in FIG. 2B. The indenter elements 24 thus bring two sides of the connector pin portion 14*a* into abutting relationship with the insulation material 18. Thereafter, a second set of indenter elements 26 having arcuate anvil surfaces are brought into contact with the section 14*a* as shown in FIG. 2C so as to compress the remainder of the section 14*a* into constriction about the insulation 18. The indenter elements 24 remain in position while the indenter elements 26 are compressed toward pin 10 so as to prevent the contact portion 14*a* from deforming in another direction. While the result of this form of crimping action may not produce a uniformly smooth connection between the section 14*a* and insulation 18, the material of the contact is pressed against and into the insulation 18 with sufficient force to provide the moisture proof coupling as necessary to preclude or minimize moisture intrusion into the connector pin and causing corrosion of the aluminum conductor 16.

Figure 3:
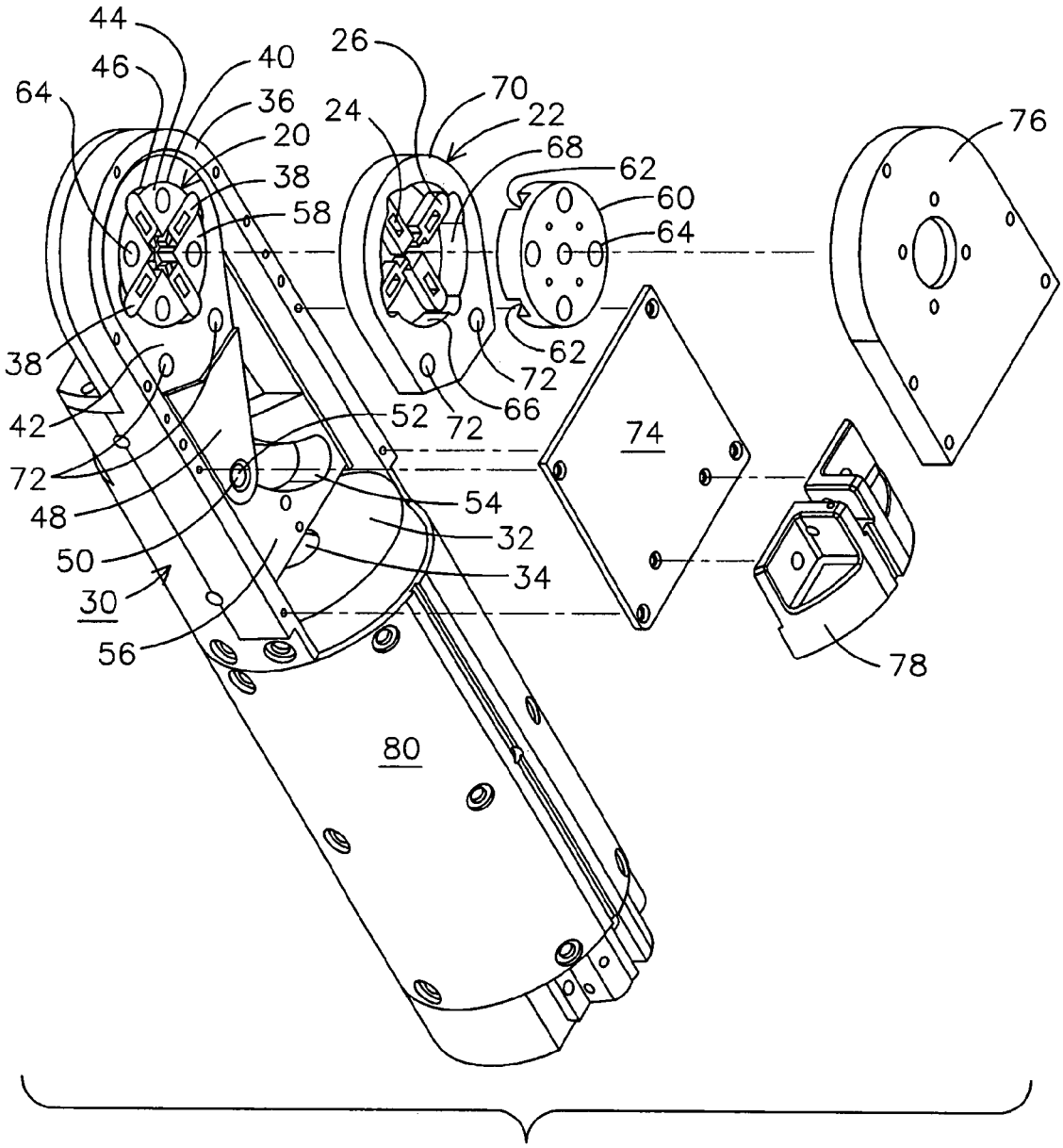
FIG. 3 illustrates one form of pneumatically-operated tool for implementing the indenting/crimping functions in accordance with one form of the present invention.

FIG. 3 illustrates one form of tool head 30 for use as a compound indenter incorporating the indenters 20,22 discussed above. Head 30 includes a circular base plate 32 having a central aperture 34 for passage of an actuating rod (not shown). A housing section 36 is attached to base plate 32 and provides both a covering and a support for the indenters 20,22 and associated actuating mechanism. The indenter 20 comprises the indenter elements 38 mounted within a circular opening 40 in pivotable actuator 42. The opening 40 has an inner surface 44 which functions as a camming surface in contact with distal ends of the indenter elements for driving the indenter elements 38 radially inward when the surface 44 is rotated about a center of the opening 40. The camming surface 44 has a plurality of shaped recessed areas 46 in which the elements 38 are retracted to create the central opening into which one of the pins 10 can be inserted. Rotation of the surface 44 causes the elements 38 to ride out of the areas 46 and be driven radially inward to indent the pin section 14. Spring elements (not shown) well known in the art may be used to forcefully retract the elements 38.

The actuator 42 has an offset arm 48 extending away from the opening 40. At a distal end of the arm 48 there is a bore 50 for receiving an axle 52. A roller or cam follower (not shown) is mounted on the axle 52 and positioned to ride in curved slot 54 in sliding plate 56. Plate 56 moves in a direction transverse to base plate 32. When plate 56 is pushed upward or away from base plate 32, the roller attached to arm 48 rides in slot 54 moving from left to right as shown in FIG. 3 thereby causing actuator 42 to rotate counterclockwise. Rotation of actuator 42 causes the camming surface 44 to drive elements 38 radially inward to effect the indenting function. The elements 38 are released by pulling the plate 56 downward toward base plate 32.

It will be appreciated that elements 38 do not rotate about opening 40 but are held fixed in orientation within tool head 30. The elements 38 are coupled to tool head 30 by a round support bracket 58 which fits into opening 40. The bracket 58 is a mirror image of support bracket 60. Each bracket 58, 60 had a plurality of radially extending slots 62. The elements 38 are seated in slots 62 of bracket 58 and the elements 24, 26 of indenter 22 are seated in slots 62 of bracket 60. When tool head 30 is assembled, bracket 60 overlays and is aligned with bracket 58 so that screws (not shown) may be inserted through aligned screw holes 64 in brackets 58,60 and threadedly engaged with mating holes in housing section 36 to thereby fix the position of the indenters 20,22 with respect to tool head 30.

The indenter 22 is also formed as a combination of the indenter elements 24,26 and a cam surface 66. The surface 66 is a radially inner surface of an opening 68 in a generally circular actuator 70 with distal ends of the elements 24,26 in sliding engagement with the cam surface 66. The elements 24,26, seated in bracket 60 fit into opening 68 in the same manner as described for indenter 20. When assembled, the actuator 70 is bolted to actuator 42 and rotates concurrently. Bolts (not shown) threadedly couple actuators 42 and 70 via bores 72.

A cover plate 74 fits onto and protects the operating elements adjacent base plate 32. An upper cover 76 has a recessed area (not visible in FIG. 3) to fit over the actuator 70. Both plate 74 and cover 76 are coupled to housing section 36 by screws (not shown) passing through the variously shown screw holes. A trigger support bracket 78 is also mounted to the housing section 36 for supporting an actuating trigger (not shown) which may be used in conjunction with a pneumatic operated indenter. The pneumatic cylinder 80 attached to base plate 32 may be a bi-directional unit having a piston extending through aperture 34 and attached to plate 56. Cylinder 80 is a conventional pneumatic actuator as is the locating and attachment of a trigger mechanism to bracket 78.

The indenters of the present invention may also be used in a hand tool in which the cycling of the hand tool is such that crimping of the pin onto the wire is completed prior to the hand tool being completely closed. While this same feature could be used with the pneumatic indenter of FIG. 3, it is not believed necessary since the bi-directional ability of the pneumatic cylinder will forcefully reverse the cam actuator 42. More particularly, the hand tool is designed with a crimping function such that as the handles of the tool are compressed towards each other, the crimping action completes the crimping of the pin onto the wire and the associated insulation and thereafter the indenters are released from the pin prior to the time that the hand tool completes a fully closed cycle. In this manner, the pressure on the indenters in the hand tool against the pin is released prior to full closure of the hand tool thus allowing the crimped wire and pin to be released from the tool. When the pin is removed, the tool can be easily opened. Otherwise, opening the tool with the pin remaining in place requires significant effort to effect a release of the indenters if they are in contact with the pin. This feature is readily implemented by designing the camming surfaces, such as surfaces 44 and 66 of FIG. 3, to have a recess that allows the indenting elements to retract as the tool reaches the end of the crimping cycle.

Figure 4:
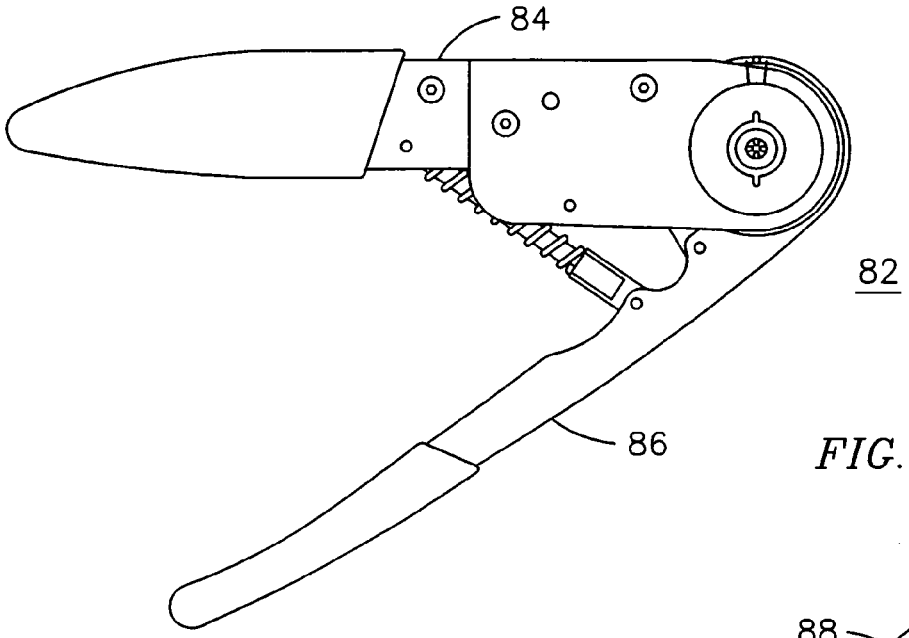
FIG. 4 illustrates one form of hand tool with which the present invention may be used.

Manually operated hand tools are well known in the art and may take the form of the plier type hand tool 82 shown in FIG. 4. However, the tool 82 is modified to incorporate two sets of indenters into a single tool so as to form a compound indenter tool. The two sets of indenters are preferably stacked as shown in the embodiment of FIG. 3 so that concurrent operation is achieved. In this tool, the indenter elements are fixed in position with respect to the non-pivoting handle 84. The camming elements are connected to the pivotable handle 86 so that pivoting movement of handle 86 with respect to handle 84 effects rotation of the cam surfaces of the camming elements. Various methods of attaching the handles 84 and 86 to each other for such pivoting movement are well known in the art as is the method for coupling the camming elements to the pivoting handle 86. Methods of effecting retraction of indenter elements such as elements 38,24,26 are also well known in the art. However, FIGS. 5 and 6 are provided to show the motion of the inventive cam arrangement coupled to the tool 82. FIG. 5 comprises the group of FIGS. 5A–5D showing selected steps of movement of the indenter 22 for crimping pin 10 to insulation 18 while FIG. 6 comprises the group of FIGS. 6A–6D showing corresponding steps of movement of indenter 20 for crimping pin 10 to wire 16. The pivotable handle 86 is indicated by line 88 to illustrate the position of the handle during the crimping cycle.

Figure 5B:
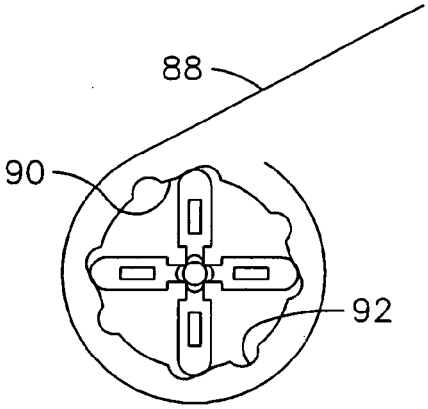
FIGS. 5*a*–5*d* and FIGS. 6*a*–6*d* illustrate corresponding indenter element positions of each of a pair of indenters in a single tool.
Figure 5A:
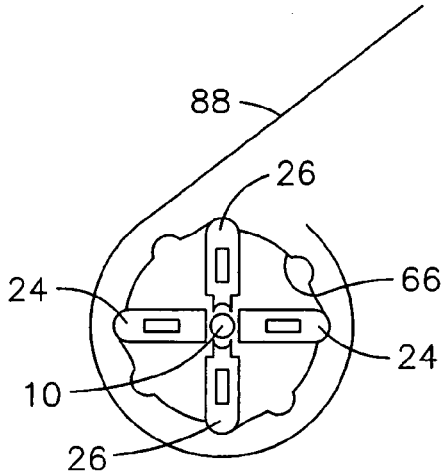
Figure 5D:
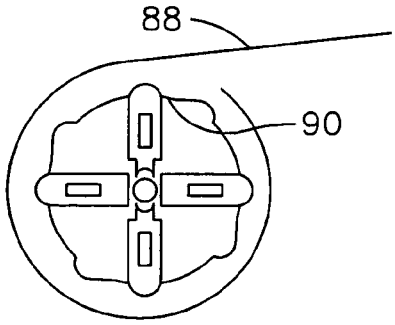
Figure 5C:
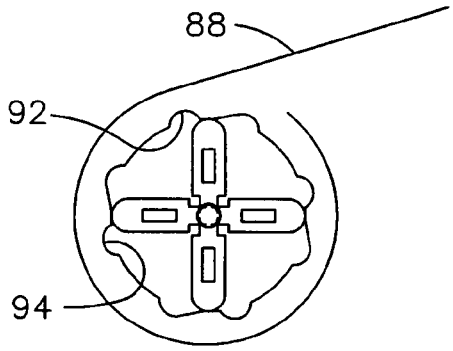
Figure 6A:
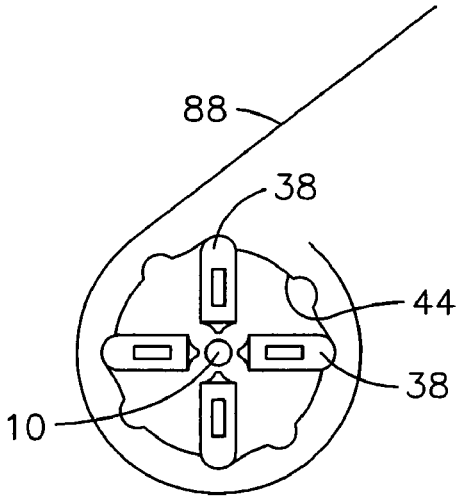
Figure 6B:
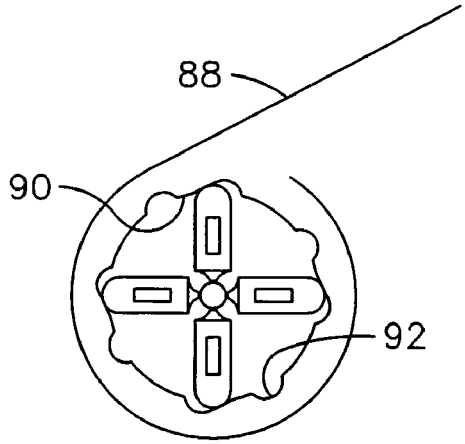
Figure 6C:
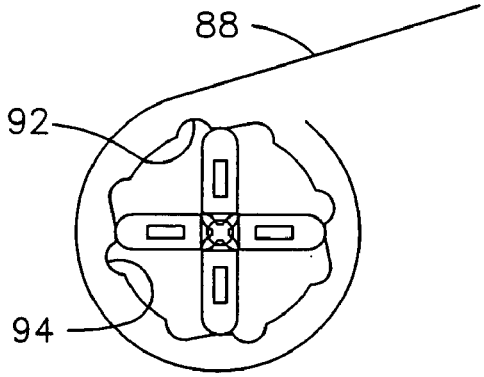
Figure 6D:
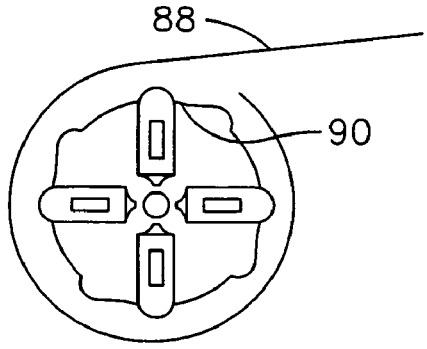

In FIGS. 5A and 6A, the handle 86 is in the fully open position and the indenter elements 38 for the pin to wire crimp and the indenter elements 24,26 for the pin to insulation crimp are all shown in the retracted position with respect to pin 10. As the handle 86 is compressed toward handle 84, the cam surfaces 44, 66 begin to rotate and drive the indenter elements radially inward into contact with the pin as shown in FIGS. 5B and 6B. In FIGS. 5C and 6C, the indenter elements have ridden up onto the most radially inward surface 90 of each cam surface and have completed the crimp of the pin 10 onto the wire 16 and insulation 18. As the handle 84 is compressed further, the cam surface continues to rotate into the position shown in FIGS. 5D and 6D such that the indenter elements have followed the cam surface into respective recessed areas 92 so that the indenter elements are retracted from contact with the pin 10. At this time the wire with the pin 10 crimped thereon may be easily withdrawn from the tool 82 and then the handle 84 released to allow the tool to recycle back to the starting position with the indenter elements retracted into the respective starting recesses 94.

While the invention has been described in what is presently considered to be a preferred embodiment, various modifications will become apparent to those skilled in the art. It is intended therefore that the invention not be limited to the disclosed embodiment but be interpreted within the spirit and scope of the appended claims.

What is claimed is:

1. A compound indenter for a wire connector pin, the pin having an axial length and an opening at an end thereof for receiving a wire having an exposed portion and an insulation covered portion, the opening being sized to receive both the exposed portion and a length of the insulation covered portion, the indenter comprising:

a first indenter section having a plurality of radially movable indenting elements for engaging the pin in a first axial location overlaying the exposed portion of the wire inserted in the pin;

a second indenter section having a plurality of radially movable Indenting elements for engaging the pin in a second axial location overlaying the insulation covered portion of the wire inserted in the pin; and apparatus for advancing the indenting elements of each of the first and second indenter sections generally concurrently for compressing respective axially spaced sections of the pin into engagement with the exposed wire portion and the insulation covered portions of the wire, the apparatus comprising a first rotatable cam surface engaging a radially outer end of the indenting elements of the first indenter section and a second rotatable cam surface engaging a radially outer end of the indenting elements of the second indenter section, each cam surface being adapted to release each indenting element prior to full cycling of the indenter.

2. The compound indenter of claim 1 wherein each rotatable cam surface is coupled to a pivotable handle of a plier type hand tool.

3. The compound indenter of claim 1 wherein each rotatable cam surface is coupled to a pivoting arm having a cam follower riding in a horizontally oriented, curved slot in a vertically operating actuator.

4. The compound indenter of claim 3 wherein the vertically operating actuator is connected to be reciprocally driven by a pneumatic actuator.

5. An indenter for a wire connector pin comprising;

a first indenter section having a first pair of opposed indenter elements having facing flat anvil surfaces and a second pair of opposed indenter elements having facing arcuate anvil surfaces, the first and second pairs of indenter elements being oriented at substantially ninety degree angles;

an operating mechanism adapted for compressing the indenter elements of the first pair towards each other to deform a portion of the connector pin into a generally oval configuration and to thereafter compress the indenter elements of the second pair into engagement with the deformed portion until the portion is compressed into a generally circular configuration, the operating mechanism comprising a first rotatable cam surface engaging a distal end of each of the indenter elements;

manually operable plier type handles, one of the handles having the indenter elements mounted thereto and the other of the handles having the rotatable cam surface mounted thereto, whereby compressing of the handles toward one another is effective to rotate the cam surface with respect to the indenter elements for initiating radially Inward movement of the indenter elements; and a second indenter section coupled in axial alignment with the first indenter section, the second indenter section having a plurality of indenting elements actuated by a second cam surface connected for concurrent rotation with the first cam surface, the second indenter section indenting the pin at a second portion thereof.

6. The indenter of claim 5 wherein the pin has an axial length and an opening at an end thereof for receiving a wire having an exposed portion and an insulation covered portion, the opening being sized to receive both the exposed portion and a length of the insulation covered portion, the first indenter section being adapted for crimping the portion of the pin overlaying the insulation covered portion of the wire.

7. The indenter of claim 6 and including a second indenter section for crimping the connector pin in the portion overlaying the exposed portion of the wire.

8. The indenter of claim 7 wherein the first and second indenter sections operate substantially concurrently.

9. The indenter of claim 5 and including a pneumatically operated piston, an offset arm connected to each cam surface, and a reciprocally operable mechanism connected to the offset arm for effecting bi-directional rotation of each cam surface.

10. The indenter of claim 5 wherein the second indenter includes four indenter elements spaced circumferentially about the pin.

11. A method of sealing an insulated electrical wire to a connector pin, the pin having an enlarged opening for receiving a portion of the wire with the insulation intact, the method comprising the steps of:

compressing the pin at an end thereof overlaying the insulation using a first pair of opposed anvils having a generally flat contact surface such that the end of the pin assumes a generally oval circumferential shape; and holding the pin in the first pair of opposed anvils so as to maintain the diameter of the pin between the anvils while compressing the pin in a perpendicular direction with a second pair of opposed anvils so that the material of the pin is compressed into tight engagement with the insulation; the second pair of opposed anvils being compressed forward into the pin in sliding contact with the flat contact surface of the first pair of opposed anvils; and indenting the pin at a second location spaced from the end thereof concurrently with compression of the end so as to fix the pin to the wire.

12. The method of claim 11 and including a cam surface for engaging an outer end of the anvils for driving the anvils into engagement with the pin, the method including advancing the anvils into the pin by rotation of the cam surface.

* * * * *